US009885330B1

(12) United States Patent
Xu

(10) Patent No.: US 9,885,330 B1
(45) Date of Patent: Feb. 6, 2018

(54) HIGH-PRESSURE FUEL PUMP ACTUATOR USED IN ENGINE

(71) Applicant: Hangzhou XZB Tech Co.,Ltd, Hangzhou (CN)

(72) Inventor: Na Xu, Hangzhou (CN)

(73) Assignee: Hangzhou XZB Tech Co., Ltd., Hangzhou (CN)

( * ) Notice: Subject to any disclaimer, the term of this patent is extended or adjusted under 35 U.S.C. 154(b) by 0 days.

(21) Appl. No.: 15/361,017

(22) Filed: Nov. 24, 2016

(30) Foreign Application Priority Data

Oct. 26, 2016 (CN) ..... 2016 1 0947860
Oct. 26, 2016 (CN) ..... 2016 2 1170776

(51) Int. Cl.
*F02M 59/44* (2006.01)
*F02M 59/10* (2006.01)

(52) U.S. Cl.
CPC ..... *F02M 59/102* (2013.01)

(58) Field of Classification Search
CPC ..... F02M 59/102
USPC ..... 123/495
See application file for complete search history.

(56) References Cited

U.S. PATENT DOCUMENTS 5,404,855 A * 4/1995 Yen ..... F02M 41/16 123/446
6,763,808 B2 * 7/2004 Ryuzaki ..... F02M 59/08 123/446
6,769,413 B2 * 8/2004 Ishimoto ..... F02M 39/005 123/198 C
6,776,143 B2 * 8/2004 Goodenough ..... F02M 57/023 123/446
7,661,413 B2 * 2/2010 Sato ..... F02M 59/102 123/495
2011/0088506 A1 * 4/2011 Oishi ..... F01L 1/143 74/569
2012/0294741 A1 * 11/2012 Nishimura ..... F02M 59/102 417/437
2015/0337939 A1 * 11/2015 Van Der Mei ..... F02M 59/102 74/569
2016/0138541 A1 * 5/2016 Hauvespre ..... F01L 1/18 123/90.44
2016/0177902 A1 * 6/2016 Frank ..... F02M 39/02 123/508
2016/0245248 A1 * 8/2016 Ando ..... F02M 59/102

* cited by examiner

*Primary Examiner* — Hai Huynh
(74) *Attorney, Agent, or Firm* — Gokalp Bayramoglu

(57) ABSTRACT

A high-pressure fuel pump actuator used in an engine, which is used in a fuel injection system of an engine, is mounted on between a driving cam and a fuel pump plunger. The pump actuator includes a guide sleeve, a U-shaped holder, and a pin shaft roller set. The U-shaped holder is formed by stamping the steel plate integrally. The guide sleeve uses a special windowing manner. Both ends of the pin shaft do not need riveting. The structure of the present invention has less number of parts and integrated functions, which can notably reduce the entire weight, the inertial force, the friction, and the abrasion. The operation is steady. The efficiency of the engine is improved.

10 Claims, 6 Drawing Sheets

HIGH-PRESSURE FUEL PUMP ACTUATOR USED IN ENGINE

CROSS REFERENCE

This application claims priority to Chinese Patent Application No. 201610947860.5, filed on Oct. 26, 2016, and claims the other priority to NO. 201621170776.9, filed on Oct. 26, 2016, the entire contents of which are incorporated herein by reference.

TECHNICAL FIELD

The invention relates to the technology field of engine apparatus, especially relates to a high-pressure fuel pump actuator used in an engine.

BACKGROUND

The pump actuator is an important part of the automobile engine using high-pressure fuel pump system, and is mounted between the driving cam and the tappet to transform the rotational motion of the driving cam into the linear reciprocating motion of the tappet. The main structure of the pump actuator includes a shell, a holder, a roller and a pin.

The existing guide sleeve of high-pressure fuel pump actuator is a housing which is in a shape of a cylinder, which is made from the complex cold forming process. The mechanical manufacturing cost is high, which lead to a high cost of the tappet. Also, the efficiency of using the material cannot be optimized. The guide sleeve and the holder are formed together by forging. Thus, the lateral force acting on the holder will transmit to the guide sleeve from the driving cam, which causes the vibration of the guide sleeve inside the cylinder. This will damage the cylinder and the guide sleeve. Moreover, the guide block on the side of the guide sleeve which is used for restraining the axial rotation of the pump actuators is a structure in which the guide block embeds in the housing. Thus, the manufacture and assembly process is more complex.

SUMMARY

To solve above technical problem, the invention provides a high-pressure fuel pump actuator used in an engine, whose structure and assembly process are simple. The number of parts, the cost, and the weight are reduced. Unnecessary friction between different parts is cut down. The reliability is improved.

To achieve the above purposes, technical solutions used by the invention are as follows:

A high-pressure fuel pump actuator used in an engine, which is used in a fuel injection system of an engine, is mounted between a driving cam and an fuel pump plunger. The pump actuator includes a guide sleeve, a U-shaped holder, and a pin shaft roller set. The pin shaft roller set is mounted on the U-shaped holder. The U-shaped holder is mounted in the guide sleeve. The left side wall and the right side wall are provided with two flanges respectively. The U-shaped holder is molded integrally. Compared with the existing structure, the overall thickness of the wall of the U-shaped holder is thicker, such that it can bear more load. The U-shaped holder directly bears the load from the driving cam and the high-pressure fuel pump to reduce the load of the guide sleeve, such that the friction loss is significantly reduced. The U-shaped holder includes a bottom plate. The left and the right side of the bottom plate is respectively provided with a piece of an upward side plate. After assembly, the side plate is locked between two flanges, such that it can avoid waggling. The flanges act to fix the side plate. Positions on the same horizontal level on two pieces of side plates are respectively provided with axle holes, which are used to mount and support the pin shaft roller set. The internal wall of the guide sleeve is provided with a ring groove which recesses inwardly. the back side of the bottom plate is provided with the tail portion whose end surface is arc-shaped. After assembly, the tail portion is locked in the ring groove, which acts as mounting and fixing the tail portion. After the pump actuator is assembled in the engine, the pin shaft roller set pushes against the driving cam. The U-shaped holder pushes against the fuel pump plunger. The rotation of the driving cam is transformed into the linear reciprocate movement of the pump actuator. Meanwhile, the fuel pump plunger is driven to move.

Preferably, the guide sleeve is a cylindrical structure which is molded integrally. The symmetrical positions on the left and the right side walls of the guide sleeve are provided with windows. The window is located at the middle position of the guide sleeve. Both ends of the guide sleeve keep the cylindrical structure, which enables both ends to function as the all-round guide. It has a good guidance quality. Thus, the height of the guide sleeve can be reduced significantly. Therefore, the overall structure height of the high-pressure fuel pump actuator can be reduced significantly.

Preferably, the height of the window can cover the pin shaft in the pin shaft roller set, to prevent the pin shaft from slipping out. Thus, the pin shaft does not need to be specifically fixed and mounted.

Preferably, when the specific window of the guide sleeve is open, a part of the material on both sides of the window is bent inwardly, to form two flanges with a gap which fits the width of the U-shaped holder side plate. The two flanges act as stoppers that effectively prevent the tilting and rotating of the U-shaped holder with respect to the guide sleeve.

Preferably, the bottom of the front side of the guide sleeve is provided with a notch. The front side of the bottom plate is provided with a projecting spline locking block. After assembly, the spline locking block is locked in the notch and projects out of the outer wall of the guide sleeve. The combination of the notch and the spline locking block has two functions. First, it is used to limit the rotation of the U-shaped holder inside the guide sleeve. Second, it is used to limit the entire pump actuator. When performing the overall assembly, the spline locking block is mounted in the locking groove of the cylinder of the fuel pump, so as to prevent the entire spline locking block from rotating in the cylinder.

Preferably, the connection portion between the spline locking block and the bottom plate is provided with an opening groove which recesses inwardly. Its function is that, since the U-shaped holder is interference-fitted in the guide sleeve, without the opening groove, during the assembly, deformation may be caused due to the interference between solid parts. The function of the U-shaped holder will be affected. Hence, the opening groove is provided to prevent the deformation and to assure the function.

Preferably, the bottom of the back side of the guide sleeve is provided with a notch which is the same as that on the front side. Based on the consideration of machinability, the notches can be symmetrically provided on both sides of the guide sleeve, wherein both notches are in a pass-through state.

Preferably, the tail portion can completely or partially contact the ring groove, which is achieved by adjusting the shape of the arc of the end surface of the tail portion. When the arc of the end surface of the tail portion is the same as that of the ring groove, the end surface of the tail portion completely contacts the ring groove, wherein the contact width is the maximum. When the arc of the end surface of the tail portion does not match that of the ring groove, the end surface of the tail portion partially contacts the ring groove. Therefore, the contact width can be set arbitrarily if necessary.

Preferably, the tail portion and the ring groove can be assembled by different manners, nesting, riveting, stamping, etc. For example, the structure of the ring groove is that the internal wall of the guide sleeve recesses inwardly to form a groove. After assembly, the tail portion is locked in the groove to form a nested interference-fit. Otherwise, the structure of the ring groove is that the side wall of the guide sleeve is stamped inwardly to form a pair of ribs with a gap. The tail portion is pressed between the two ribs through elastic deformation, such that the tail portion is fixed by clamping.

Preferably, the side wall of the guide sleeve at the lower end of the groove deforms to form a throat. This process is conducted when the tail portion is assembled into the groove, such that the U-shaped holder is fixed better.

Preferably, the side wall of the guide sleeve at the lower end of the groove is provided with a plurality of elastic notches. When the tail portion of the U-shaped holder is pressed into the notches, the tail portion is locked.

Preferably, the bottom surface of the bottom plate can be a planar structure or a curved surface structure.

Preferably, the bottom surface of the bottom plate is provided with a protruding platform which projects downwardly. The surface of the protruding platform can be a planar structure or a curved surface structure.

Preferably, the bottom surface of the bottom plate is provided with a concave platform which recesses upwardly and inwardly. The surface of the concave platform can be a planar structure or a curved surface structure.

The above types of the structure of the bottom surface are all used for the working surface to contact the fuel pump plunger. The working surface either can be the bottom surface of the bottom plate, or on the protruding platform or the concave platform. The protruding platform and the concave platform can be formed by stamping. Moreover, the surface of these types of working surfaces can be a plane or a curved surface. As such, a better transmission is achieved, such that the working requirement is met accordingly.

Preferably, the U-shaped holder is molded integrally, which includes a bottom plate and sidewalls on both sides of the bottom plate. Since, in the mechanism, the force in the driving cam directly transmits to the fuel pump plunger through the U-shaped holder, the overall thickness of the U-shaped holder is thicker, such that the U-shaped holder can bear more load.

Preferably, the pin shaft roller set includes the pin shaft, the roller and, the roller pin. The roller pin is located between the pin shaft and the roller. The function of the roller pin is to reduce the friction loss. After assembly, the pin shaft is provided in the axle hole of the U-shaped holder. In the entire mechanism, the pin shaft is in a suspending state without hardness assembly. The function of the pin shaft roller set is to bear the force from the driving cam and to pass down the force. Since the width of the surface of the roller is wider than that of the driving cam, sufficient contact area can be ensured even when axial sliding occurs. The pin shaft function as mounting and bearing. Since both end surfaces of the pin shaft are inside the guide sleeve, the pin shaft cannot slip out due to the blocking of the guide sleeve. Thus, specific fixing manner riveting, snap ring, etc. are not necessary to limit the pin shaft. The free installation such as the windowing manner is simply needed.

The advantages of the present invention are as follows.

1. The number of the parts are less. Functions are integrated. The overall weight can be controlled effectively. The inertial force of motion, the friction, and the loss are reduced. The efficiency of the engine is improved. The overall structure is simplified because of the simplicity of parts. The cost is reduced.

2. The outer contour is the guide sleeve. The entire height has the function of guiding. The guiding effect can occur inside the entire height. Thus, it can be more stable during the work. Moreover, the height of the whole mechanism is less.

3. The pin shaft is mounted through the window, without using mounting manner like pressing or spinning rivet etc. The pin shaft is in a state of free rotation. The mounting is simple and easy. The mounting process is simplified. The assembly rate can be speed up remarkably.

4. The partial interference-fit manner of the bottom plate and the ring groove are used for assembling the U-shaped holder and the guide sleeve. Moreover, the guide sleeve does not bear the load of the running of the mechanism, such that the side plate of the U-shaped holder can be designed to be thicker since it does not need to bear the assembly function. Compared with the existing product, the U-shaped holder can bear more pressure and can work under poorer conditions.

5. Based on the rigid connection between the bottom of the U-shaped holder and the guide sleeve, the guide sleeve moves upwards and downwards together with the U-shaped holder. The mechanical property of the whole suite is ensured. The noise and abrasion are reduced.

6. Since the guide block is integrated into the U-shaped holder, the number of parts is reduced.

7. The specific design in which the pin shaft and the guide sleeve are assembled freely can increase the thickness of the U-shaped holder properly, to adapt to a high working pressure.

8. The mounting and fitting relationship of the flange of the guide sleeve and the side plate of the U-shaped holder makes no obvious vibration gap between the U-shaped holder and guide sleeve in movement, which makes the moving steady.

1, guide sleeve; 1.1, flange; 1.2, ring groove; 1.2.1, groove; 1.2.2, rib; 1.2.3, throat; 1.2.4, elastic notch; 1.3, notch; 1.4, window; 2, the U-shaped holder, 2.1, bottom plate; 2.2, side plate; 2.3, axle hole; 2.4, tail portion; 2.5, spline locking block; 3, pin shaft roller set; 3.1, pin shaft; 3.2, roller; 3.3, roller pin; 4, driving cam; 5, fuel pump plunger.

DETAILED DESCRIPTION

The present invention is further described through embodiments and drawings hereinafter.

Figure 1:
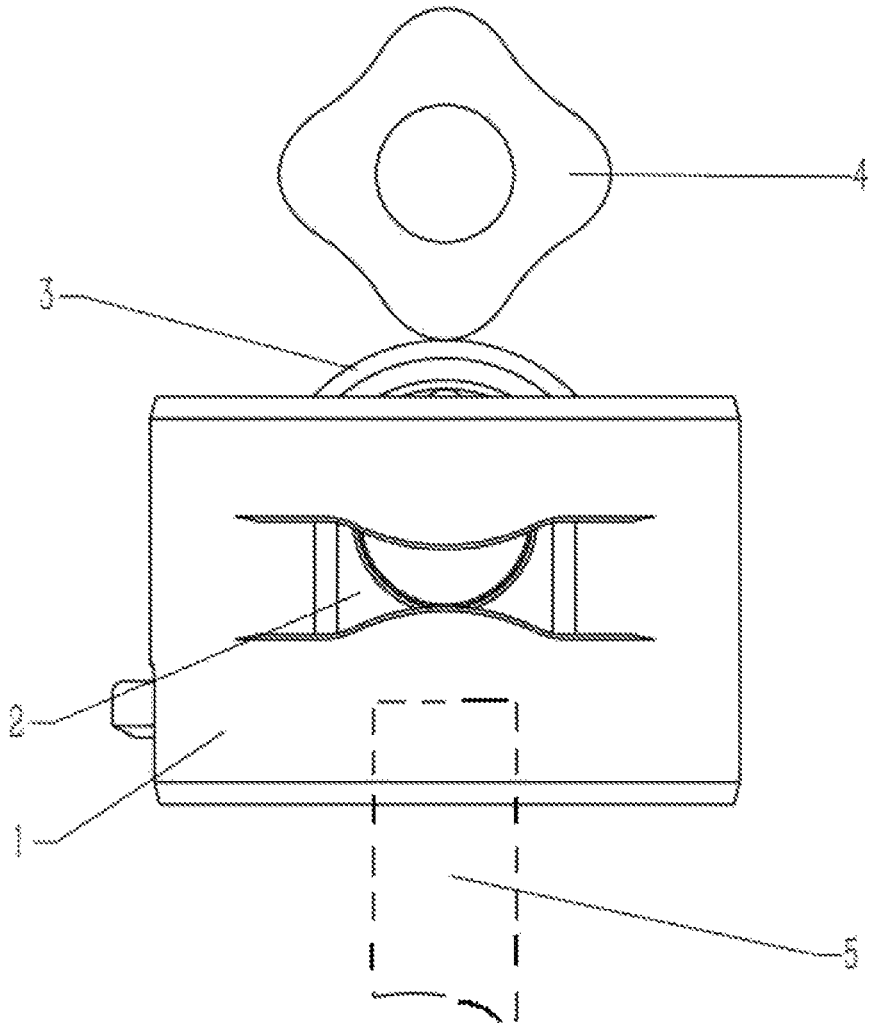
FIG. 1 is a schematic diagram of the operation of the invention.
Figure 2:
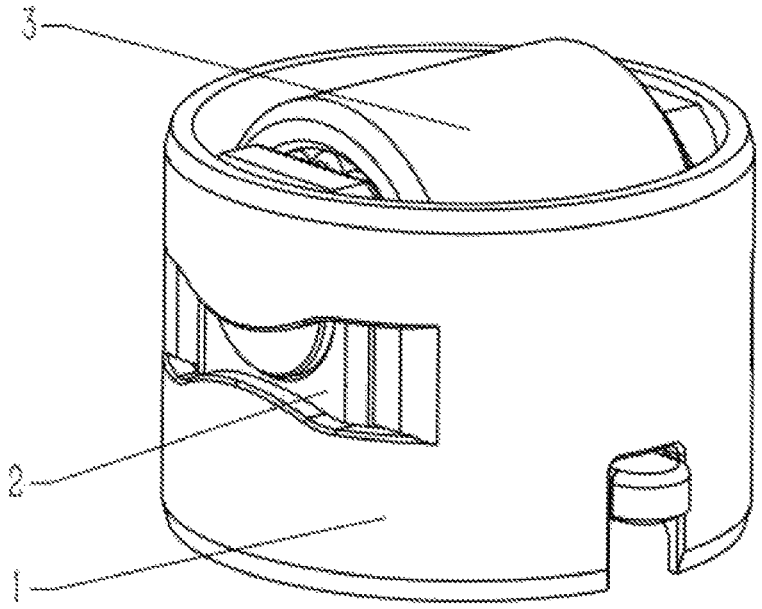
FIG. 2 is an assembly drawing of one embodiment of the invention.
Figure 3:
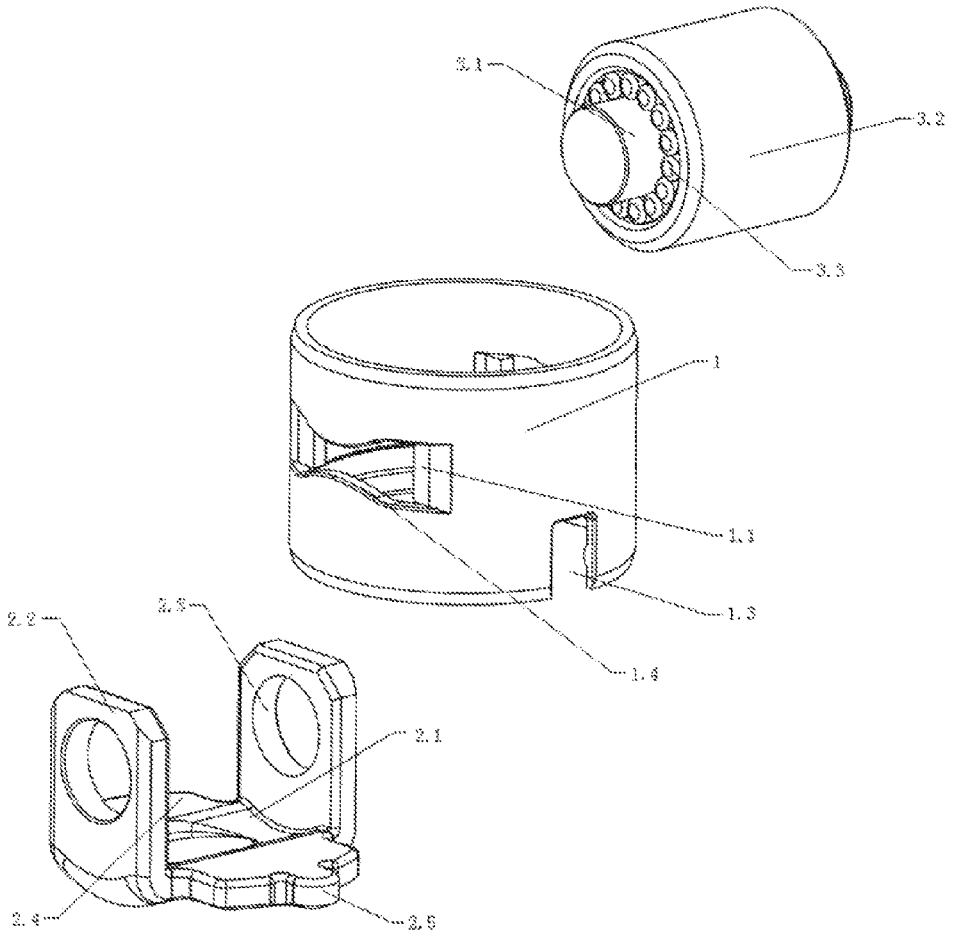
FIG. 3 is an explosive view of FIG. 2.

One Embodiment is: as shown in FIGS. 1 to 3, a high-pressure fuel pump actuator used in an engine, which is used for the fuel injection system in an engine, is mounted between driving cam 4 and fuel pump plunger 5 in the cylinder head of the engine. The pump actuator includes guide sleeve 1, U-shaped holder 2, and pin shaft roller set 3. Guide sleeve 1 is a cylinder structure, which is made from the integral forming process. U-shaped holder 2 is also made from the integral forming process. Pin shaft roller set 3 is mounted on U-shaped holder 2. U-shaped holder 2 is mounted in guide sleeve 1.

The symmetrical positions on the left and the right side walls of guide sleeve 1 are provided with windows 1.4. The left and the right internal walls of guide sleeve 1 are respectively provided with two flanges 1.1. U-shaped holder 2 includes bottom plate 2.1. The left and the right side of bottom plate 2.1 are respectively provided with a piece of upward side plate 2.2. After assembly, side plate 2.2 is locked between two flanges 1.1. Positions on the same horizontal level on two pieces of side plate 2.2 are respectively provided with axle holes 2.3 that are used to mount and support pin shaft roller set 3.

The internal wall of guide sleeve 1 is provided with ring groove 1.2 which recesses inwardly. The bottom of the front side of guide sleeve 1 is provided with notch 1.3. The back side of bottom plate 2.1 is provided with tail portion 2.4 whose end surface is arc-shaped. The front side of bottom plate 2.1 is provided with a projecting spline locking block 2.5. After assembly, tail portion 2.4 is locked in ring groove 1.2. Spline locking block 2.5 is locked in notch 1.3, and projects out of the outer wall of guide sleeve 1.

Figure 4:
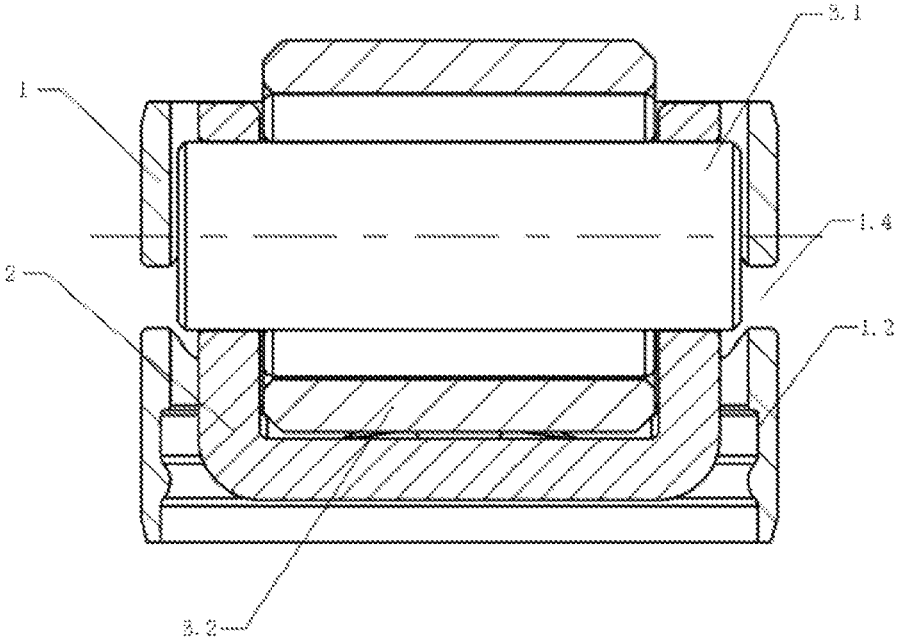
FIG. 4 is a schematic diagram showing the pin shaft the assembly relationship of the present invention.

Referring to FIG. 4, pin shaft roller set 3 includes pin shaft 3.1, roller 3.2 and roller pin 3.3. Roller pin 3.3 is located between pin shaft 3.1 and roller 3.2. After assembly, pin shaft 3.1 is provided in axle hole 2.3 of U-shaped holder. Pin shaft 3.1 is in a suspending state which does not loose in the whole mechanism without hardness assembly.

The number of notch 1.3 in the above embodiment can be two. The bottom of the back side of guide sleeve 1 is provided with notch 1.3 which is the same as that on the front side, wherein both notches are in a pass-through state.

In the embodiments of the present invention, the are shape of the end surface of tail portion 2.4 may have different variations. The purpose that the end surface of tail portion 2.4 completely or partially contacts ring groove 1.2 is achieved.

Moreover, bottom plate 2.1 in the embodiment of the present invention also has different variations.

Embodiment 1 of bottom plate 2.1: bottom plate 2.1 directly pushes against fuel pump plunger 5. the bottom surface of bottom plate 2.1 can be a planar structure or a curved surface structure.

Embodiment 2 of bottom plate 2.1: the bottom surface of bottom plate 2.1 is provided with a protruding platform which projects downwardly. The protruding platform is formed by stamping. The mechanism pushes against fuel pump plunger 5 through the protruding platform. The surface of the protruding platform can be a planar structure or a curved surface structure.

Embodiment 3 of bottom plate 2.1: the bottom surface of bottom plate 2.1 is provided with a concave platform which recesses inwardly. The concave platform is formed by stamping. The mechanism pushes against fuel pump plunger 5 through the concave platform. The surface of the concave platform can be a planar structure or a curved surface structure.

Figure 5:
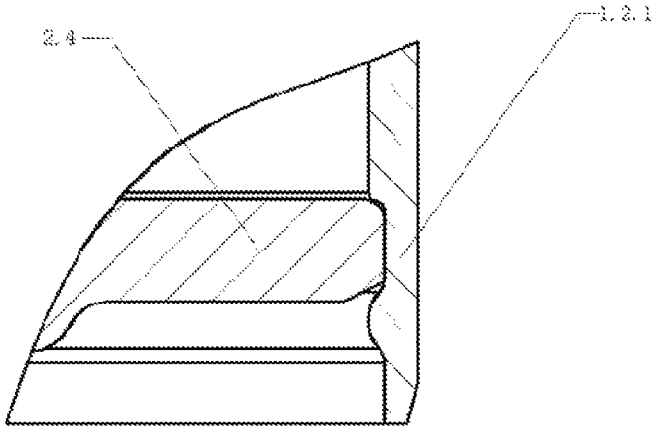
FIG. 5 is a schematic diagram showing the assembly relationship of the U-shaped holder and guide sleeve in Embodiment 1 of the present.

Moreover, in the embodiments of the present invention, the structure of ring groove 1.2 also has different variations. Accordingly, the fitting manner with tail portion 2.4 also has different variations. Details are shown as follows:

Embodiment 1 of fitting manner: referring to FIG. 5, the structure of ring groove 1.2 is that groove 1.2.1 is formed by internal wall recessing inwardly at the mounting position on guide sleeve 1. Tail portion 2.4 and groove 1.2.1 are nested in an interference fitting.

Figure 6:
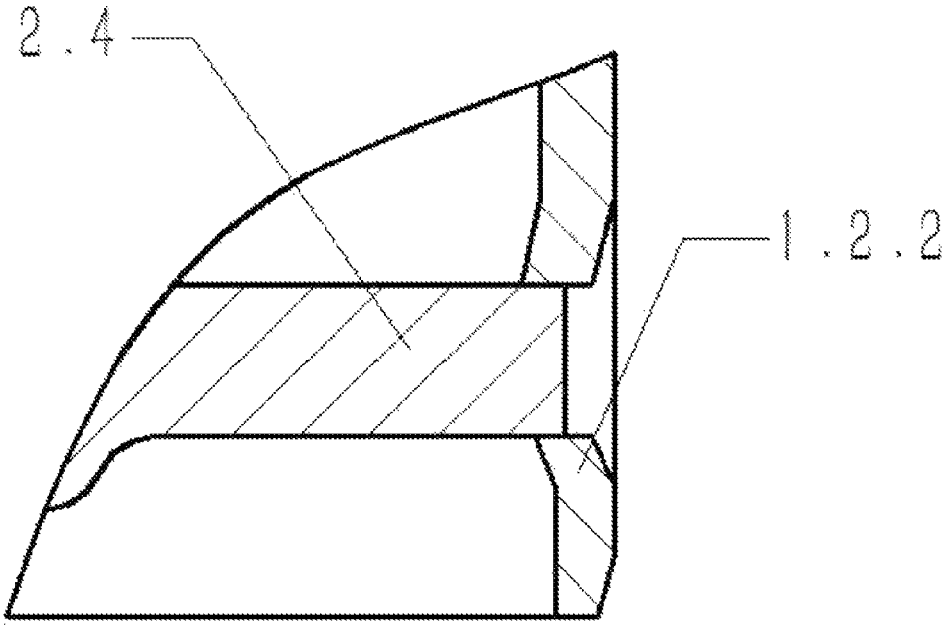
FIG. 6 is a schematic diagram showing the assembly relationship of the U-shaped holder and guide sleeve in Embodiment 2 of the present.

Embodiment 2 of fitting manner: referring to FIG. 6, the structure of ring groove 1.2 is that a pair of open-ended trumpet-shaped ribs 1.2.2 are formed by inwardly stamping the upper and the lower sidewalls at the mounting position on guide sleeve 1. Tail portion 2.4 and ribs 1.2.2 fit with each other using the manner shown in the Figure.

Figure 7:
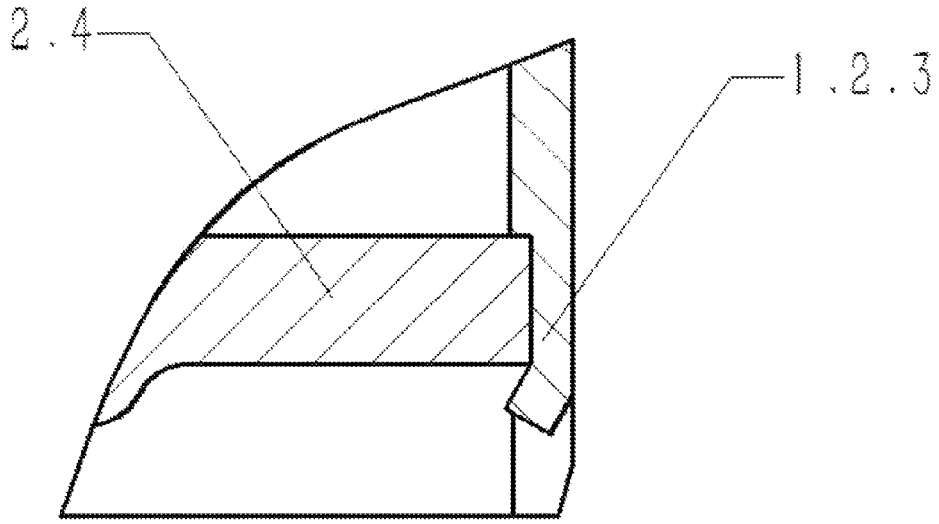
FIG. 7 is a schematic diagram showing the assembly relationship of the U-shaped holder and guide sleeve in Embodiment 3 of the present.

Embodiment 3 of fitting manner: referring to FIG. 7, the differences from Embodiment 1 are as follows. The downside of groove 1.2.1 of guide sleeve 1 is provided with throat 1.2.3 formed by spin riveting. The structure in which throat 1.2.3 is connected to groove 1.2.1 and is bent inwardly towards guide sleeve 1 is formed. After assembly tail portion 2.4 and groove 1.2.1 are connected by riveting. Finally, they fit with each other using the manner shown in the Figure.

Figure 8:
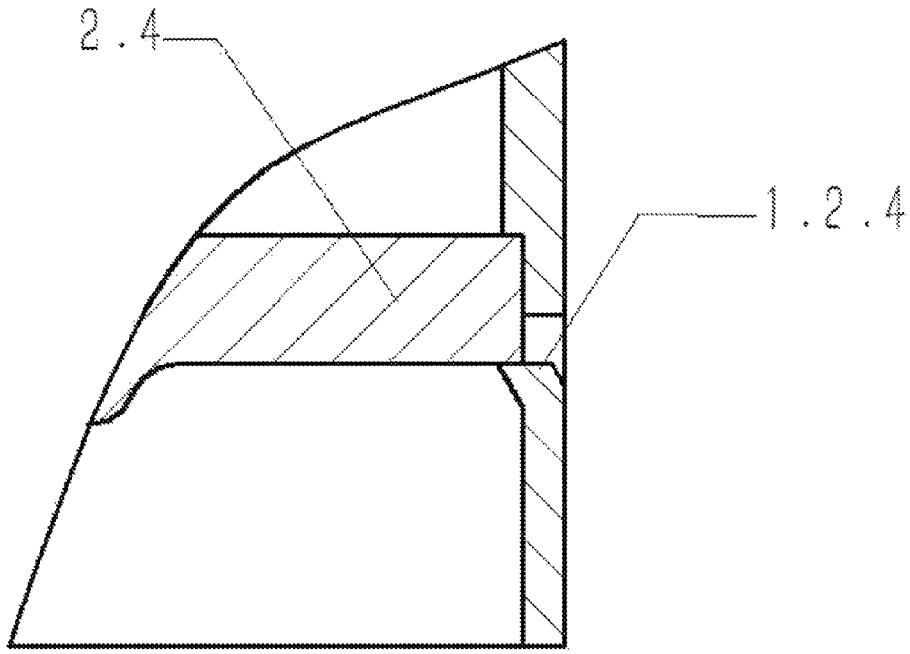
FIG. 8 is a schematic diagram showing the assembly relationship of the U-shaped holder and guide sleeve in Embodiment 4 of the present.

Embodiment 4 of fitting manner: referring to FIG. 8, it is suitable for the situation in which the height of guide sleeve 1 is high. The differences from Embodiment 1 are as follows. The downside of groove 1.2.1 of guide sleeve 1 is provided with elastic notch 1.2.4 formed by stamping. Specifically, cutting along the lower edge of groove 1.2.1 is performed. The portion of guide sleeve 1 below the cutting line is stamped inwardly. Elastic notch 1.2.4 can be one or more. Tail portion 2.4 and elastic notch 1.2.4 fit with each other using the manner shown in the Figure.

The above are only the embodiments of the invention, but the structural features of the invention are not limited thereto. The invention can be used in similar products. Any change or modification made by a person with ordinary skill in this art that falls within the scope of the invention, are covered by the patent scope of the invention.

What is claimed is:

1. A high-pressure fuel pump actuator used in an engine, which is used in a fuel injection system of an engine, is mounted on between a driving cam and a fuel pump plunger, wherein the pump actuator includes a guide sleeve, a U-shaped holder, and a pin shaft roller set, wherein the pin shaft roller set is mounted on the U-shaped holder, and wherein the U-shaped holder is mounted in the guide sleeve;

wherein symmetrical positions on a left and a right side walls of the guide sleeve are provided with windows, wherein a left and a right side walls are provided with two flanges respectively, wherein the U-shaped holder includes a bottom plate and side plates that are located on a left and a right side of the bottom plate, wherein upon assembly, the side plate is locked between two flanges;

wherein an internal wall of the guide sleeve is provided with a ring groove which recesses inwardly, wherein a back side of the bottom plate is provided with a tail portion whose end surface is arc-shaped, wherein upon assembly, the tail portion is locked in the ring groove.

2. The high-pressure fuel pump actuator used in an engine of claim 1, wherein the U-shaped holder is molded integrally and is incorporated with a spline locking block.

3. The high-pressure fuel pump actuator used in an engine of claim 1, wherein the guide sleeve is molded integrally, wherein the window is provided in a middle position, and wherein an upper portion and a lower portion of the window are of a cylinder structure.

4. The high-pressure fuel pump actuator used in an engine of claim 3, wherein the flange is formed by bending a part of material in the window inwardly.

5. The high-pressure fuel pump actuator used in an engine of claim 3, wherein the pin shaft roller set includes a pin shaft, a roller, and a roller pin, wherein the roller pin is located between the pin shaft and the roller, wherein upon assembly, the pin shaft is provided in an axle hole of the U-shaped holder, wherein the pin shaft is in a suspending state which does not loose in a whole mechanism without hardness assembly;

wherein the location of the guide sleeve of the window is arranged to limit the pin shaft axially, such that the pin shaft does not slip out.

6. The high-pressure fuel pump actuator used in an engine of claim 1, wherein the tail portion of the U-shaped holder can completely or partially contact the ring groove of the guide sleeve;

wherein a fitting manner of the tail portion and the ring groove can be:

a structure of the ring groove being that an internal wall of the guide sleeve recesses inwardly to form a groove, wherein upon assembly, the tail portion is locked in the groove, and wherein the tail portion and the groove are nested in an interference fitting; or the structure of the ring groove being that the internal wall of the guide sleeve is stamped inwardly to form a pair of spaced ribs, wherein the tail portion is pressed between the two ribs through elastic deformation, such that the tail portion is fixed by clamping.

7. The high-pressure fuel pump actuator used in an engine of claim 6, wherein a side wall of the guide sleeve at a lower end of the groove deforms to form a throat.

8. The high-pressure fuel pump actuator used in an engine of claim 6, wherein a side wall of the guide sleeve at a lower end of the groove is provided with a plurality of elastic notches.

9. The high-pressure fuel pump actuator used in an engine of claim 1, wherein a bottom surface of the bottom plate can be a planar structure or a curved surface structure.

10. The high-pressure fuel pump actuator used in an engine of claim 1, wherein the bottom surface of the bottom plate is provided with a protruding platform which projects downwardly, wherein a surface of the protruding platform can be a planar structure, or a curved surface structure; or the bottom surface of the bottom plate is provided with a concave platform which recesses upwardly and inwardly, wherein a surface of the concave platform can be a planar structure or a curved surface structure.

* * * * *